US007000263B2

(12) United States Patent
McNeal

(10) Patent No.: US 7,000,263 B2
(45) **Date of Patent: *Feb. 21, 2006**

(54) PIVOTABLE STRAP-BUCKLE ASSEMBLY

(75) Inventor: Joseph Ross McNeal, Hailey, ID (US)

(73) Assignee: Smith Optics, Inc., Ketchum, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/946,215

(22) Filed: Sep. 20, 2004

(65) Prior Publication Data

US 2005/0034225 A1 Feb. 17, 2005

Related U.S. Application Data

(63) Continuation of application No. 10/043,952, filed on Jan. 9, 2002, now Pat. No. 6,826,785.

(51) Int. Cl.
*A61D 9/02* (2006.01)

(52) U.S. Cl. ..... 2/452; 24/170

(58) Field of Classification Search ..... 2/452, 2/426, 427, 440, 444, 445, 451–453; 24/170, 24/193, 197, 308, 309, 33; 450/25, 63, 64, 450/88, 93

See application file for complete search history.

(56) References Cited

U.S. PATENT DOCUMENTS

| | | | | |
|---|---|---|---|---|
| 55,533 A | | 6/1866 | Plotts | |
| 341,127 A | | 5/1886 | Bretzfield | |
| 873,791 A | | 12/1907 | Rubin | |
| 982,433 A | | 1/1911 | Knight et al. | |
| 1,049,757 A | | 1/1913 | Negraval | |
| 1,147,955 A | | 7/1915 | Langhammer | |
| 1,278,747 A | * | 9/1918 | Pryor | 24/170 |
| 1,431,661 A | | 10/1922 | Hodge | |
| D65,201 S | | 7/1924 | Rosenblum | |
| 1,898,741 A | | 2/1933 | Peterson | |
| D125,083 S | | 2/1941 | Dickson | |
| 2,713,708 A | | 7/1955 | Anderson | 24/198 |
| 2,919,481 A | | 1/1960 | Finken et al. | 24/196 |
| 3,000,384 A | | 9/1961 | Piers, Jr. | 132/46 |
| 3,583,750 A | | 6/1971 | Norton | 294/74 |
| 3,898,715 A | | 8/1975 | Balder | 24/196 |
| 4,027,666 A | | 6/1977 | Marx | 128/165 |
| 4,112,521 A | | 9/1978 | Uke | 2/452 |
| 4,273,130 A | | 6/1981 | Simpson | 128/327 |
| 4,564,960 A | | 1/1986 | Nishiyama | 2/452 |
| D287,067 S | | 12/1986 | Kasai | D11/218 |
| 4,628,918 A | | 12/1986 | Johnson, Jr. | 128/90 |
| D290,349 S | | 6/1987 | Kasai | D11/218 |

(Continued)

OTHER PUBLICATIONS

EJ's Sunglasses, LLC, Helmet Helper, 1998-2000, Order Webpage Dec. 7, 2001.

(Continued)

*Primary Examiner*—Katherine M. Moran
(74) *Attorney, Agent, or Firm*—Dorsey & Whitney LLP

(57) ABSTRACT

This invention is directed towards an apparatus for securing and adjusting a strap. More particularly, the present invention is directed towards a buckle assembly having a pivotable member pivotably attached to opposed regions of the buckle frame. In one embodiment, a sport-goggle assembly has a pivotable buckle assembly attached to one end of a strap. In another embodiment, a sport-goggle assembly has a pivotable buckle assembly attached to each of the two straps. In other embodiments, the pivotable buckle assembly can be used in association with a strap-lengthening member.

46 Claims, 5 Drawing Sheets

U.S. PATENT DOCUMENTS

| | | | | | |
|---|---|---|---|---|---|
| 4,716,630 | A | | 1/1988 | Skyba | 24/134 |
| 4,727,628 | A | | 3/1988 | Rudholm | 24/170 |
| 4,796,336 | A | * | 1/1989 | Scully | 24/68 CD |
| 5,165,402 | A | | 11/1992 | McCoy | 128/402 |
| 5,177,837 | A | | 1/1993 | Rekuc | 24/198 |
| 5,356,412 | A | | 10/1994 | Golds et al. | 606/74 |
| 5,657,493 | A | * | 8/1997 | Ferrero et al. | 2/428 |
| 5,727,259 | A | | 3/1998 | Kawamata | 2/452 |
| 5,734,995 | A | | 4/1998 | Chiang | 2/428 |
| 5,870,816 | A | | 2/1999 | McFalls et al. | 29/434 |
| 5,881,394 | A | | 3/1999 | Garofalo | 2/428 |
| 5,971,947 | A | | 10/1999 | McNally et al. | 602/62 |
| 6,013,045 | A | | 1/2000 | Gaylord | 602/64 |
| 6,059,634 | A | | 5/2000 | Fildan | 450/86 |
| 6,070,272 | A | | 6/2000 | Chiang | 2/442 |
| 6,119,276 | A | | 9/2000 | Newcomb et al. | 2/425 |
| 6,149,617 | A | | 11/2000 | McNally et al. | 602/62 |
| 6,212,740 | B1 | * | 4/2001 | Yang et al. | 24/170 |
| 6,295,700 | B1 | | 10/2001 | Plzak | 24/134 R |
| 6,446,269 | B1 | * | 9/2002 | Bessler et al. | 2/321 |
| 6,826,785 | B1 | * | 12/2004 | McNeal | 2/452 |

OTHER PUBLICATIONS

Jenn Weede, Smith Helmet Helper, www.ruhooked.com, Hooked on the Outdoors Magazine: Gear Review, Dec. 7. 2001.

* cited by examiner

PIVOTABLE STRAP-BUCKLE ASSEMBLY

CROSS-REFERENCE TO RELATED APPLICATION

This application is a continuation of U.S. patent application Ser. No. 10/043,952, filed Jan. 9, 2002, now U.S. Pat. No. 6,826,785.

TECHNICAL FIELD

This invention relates generally to buckles, and more particularly, to buckle assemblies for use in association with straps.

BACKGROUND OF THE INVENTION

Individuals often wear goggles to protect their eyes or to improve their vision when participating in a sport or a recreational activity, such as skiing, motorcycle racing or snowmobiling. During use, a strap holds the goggles in place on the wearer's head. The strap length is typically adjusted and held securely in place by use of a buckle.

FIG. 1 shows a buckle configuration typically used to secure and adjust the length of a strap commonly used with sport goggles. The buckle 2 is unitary, and includes two slots 14, 16 that are bordered by sides 10, 12 and a center bar 18. The slots 14, 16 are sized to receive a strap (not shown).

To secure and adjust a pair of sport goggles, two buckles 2, 3 and two straps 22, 24 are typically used, as shown in FIG. 2. The first and second buckles 2, 3 are substantially identical, and are generally of the type shown in FIG. 1. In operation, a pair of sport goggles 20 have a first strap 22 and a second strap 24 attached to lateral sides 26, 28, respectively, of the goggles 20. The end of the first strap 22 is threaded through a slot 34 on the buckle 2, looped back, and attached to the first strap at a point 36. The second strap 24 is looped over the center bar of the second buckle 3 and one end is attached to the strap 24 at a point 40. Another end 42 of the second strap 24 is threaded upwardly through a slot 46 on the first buckle, and brought back towards the second buckle 3. The second strap 24 is further threaded upwardly through a slot 48 on the second buckle, over the center bar (not shown), downwardly through the second slot 16, then attached to the lateral side 34 of the sport goggles 20. This configuration allows the user to lengthen or shorten the overall length of the assembly by sliding the second buckle 3 to and fro along the length of the second strap 24.

The buckle and strap assembly shown in FIG. 2 works adequately to facilitate lengthening and shortening of the assembly, but it is not without problems. As shown in FIG. 2, loops 50, 52 are formed in the first and second straps 22, 24. The loops 50, 52 are typically formed by sewing a strap end back onto the strap itself. For example, FIG. 2 shows the ends of the first and second straps 22, 24 attached at points 36, 40 to form the loops 50, 52 around the center bars of the buckles 2, 3.

The stitching is usually performed by a factory worker, who must sew each individual strap. The sewing step is a bottleneck in the manufacturing process since the sewing is not performed by an automated process. Sport goggles having sewn straps can not be shipped to the retailer in pieces, and must be fully assembled at the factory prior to shipment. Thus, performing this step by hand decreases the manufacturer's throughput of the sport-goggles assembly, while increasing the attendant manufacturing costs.

The end user also encounters problems with sport-goggles assemblies having sewn straps. For example, buckles cannot be replaced by the user without specialized equipment, and are typically returned to the factory for repair. Because the strap is sewn, the buckle cannot be replaced without removing the stitches, removing the buckle, and re-sewing the strap to secure a new buckle. An industrial sewing machine is recommended to provide stitching sufficient to provide a secure loop to anchor the strap to the buckle. As such, sport-goggles users can not replace a damaged buckle without significant difficulty, expense, and delay.

As previously described, the sport-goggles assembly as shown in FIG. 2 may not be disassembled and reassembled without specialized equipment and substantial effort. In pursuit of sports such as skiing, users may choose to wear a helmet. The circumference of a user's helmet is necessarily larger than the user's head. Using the sport-goggles assembly shown in FIG. 2, it is difficult to quickly and easily provide additional strap length if a user should desire to use a particular sport-goggles assembly in association with a helmet.

A need therefore exists for an improved buckle for use with a strap that can be removed, replaced, and allow the overall length of the strap to be increased without the use of specialized equipment.

SUMMARY OF THE INVENTION

The present invention is directed towards buckle assemblies having a pivotable member mounted within a frame. One buckle in accordance with the invention includes a frame having an exterior border and an interior border, and a pivotable member pivotably attached to two opposed portions of the interior border. The pivotable member has a longitudinal axis and is adapted to attach to a strap along the longitudinal axis. In accordance with certain aspects of the invention, the pivotable bar may be selectively detachable, the strap may be elastic, and the buckle frame may have a flange along a border generally parallel to the pivotable member.

In another embodiment in accordance with the present invention, a pair of sport goggles has two straps attached to respective lateral sides. One of the straps is attached to a pivotable buckle assembly.

In another embodiment in accordance with the present invention, a pair of sport goggles has two straps attached to respective lateral sides. One of the straps is attached to a pivotable buckle assembly. The other strap is selectively engageable with the pivotable buckle assembly or with a third strap. The third strap is adapted to be engageable with the buckle assembly.

Yet another embodiment in accordance with the present invention includes a pair of sport goggles that has two straps attached to respective lateral sides with a pivotable buckle assembly attached to each of the ends of the two straps respectively. In another embodiment in accordance with the present invention, a member is connected to loops formed with the first and second straps to add overall length to the sport-goggles assembly.

DETAILED DESCRIPTION OF THE INVENTION

The present invention is generally directed to a buckle apparatus for securing and adjusting the length of a strap and to a sport goggle using the buckle. More particularly, the present invention is directed to a buckle apparatus for use with sport goggles. Many of the specific details of certain embodiments of the invention are presented in the following description and in FIGS. 3–8 to provide a thorough understanding of such embodiments. One skilled in the art will understand, however, that the present invention may have additional embodiments, or that the present invention may be practiced without several of the details described in the following description. For example, one skilled in the art will understand that in the following discussion the buckle is described as securing sport goggles to the user during operation, but the buckle may be used to secure any object suitable for attachment to a strap.

Figure 1:
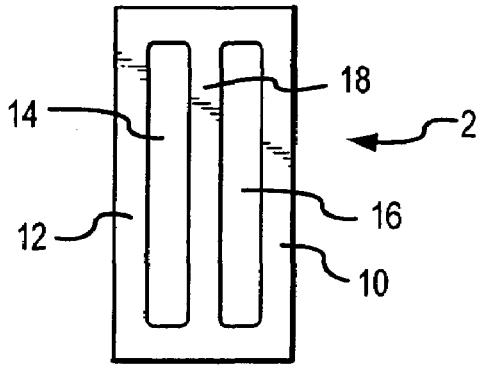
(PRIOR ART) FIG.1
FIG. 1 is a plan view of a buckle according to the prior art.
Figure 2:
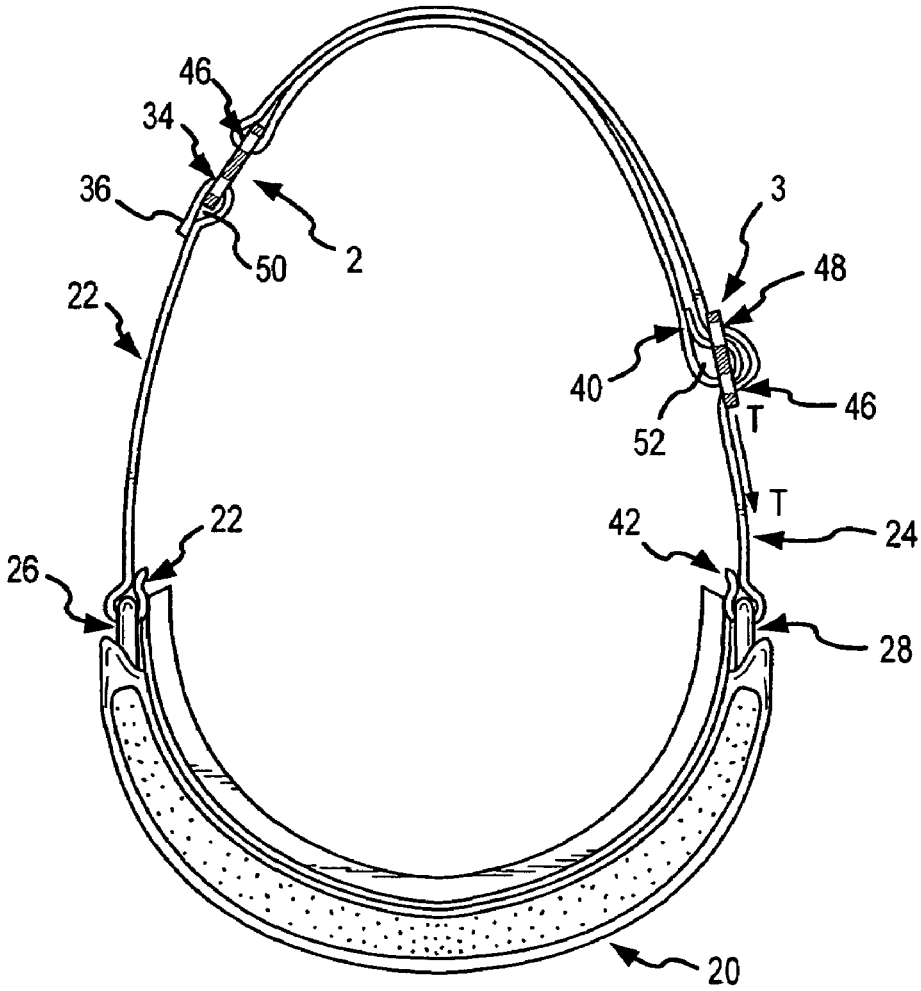
(PRIOR ART) FIG.2
FIG. 2 is a top view of a goggles assembly according to the prior art.
Figure 3A:
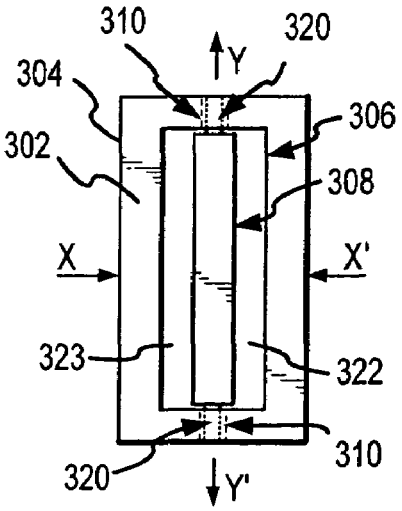
FIG. 3A is a plan view of a buckle and strap assembly according to an embodiment of the present invention.
Figure 3B:
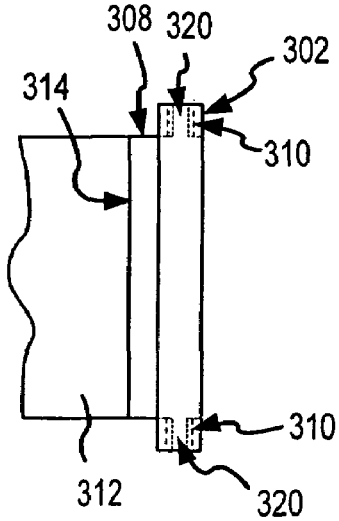
FIG. 3B is a front view of a buckle and strap assembly according to an embodiment of the present invention.
Figure 3C:
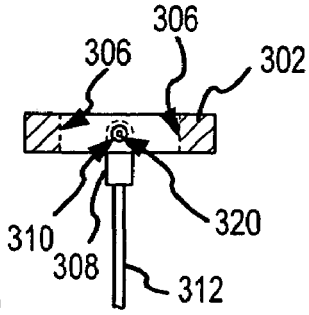
FIG. 3C is a side view of a buckle and strap assembly according to an embodiment of the present invention.

FIGS. 3A, 3B and 3C are a plan, front and side view, respectively, of a buckle and strap assembly according to an embodiment of the present invention. The buckle includes a frame 302, which has an exterior border 304 and an interior border 306. A bar 308 is pivotably attached to two opposed locations of the interior border 306 defining two slots 322, 323 as shown, for example, in FIG. 3A. As best shown in FIGS. 3A and 3B, the bar 308 may be pivotably mounted to the frame 302 by inserting pins 320 into holes 310 on the frame 302 thereby facilitating the pivotability of the bar 308 by allowing the bar 308 to rotate on the pins 320. The frame 302, bar 308, and pins 320 may be constructed of any suitable material such as metal or plastic, though injection-molded thermoplastic elastomer tends to provide the ideal amount of rigidity and compliance.

As best shown in FIG. 3B, a strap 312 may be attached along the longitudinal axis 314 of the bar 308. Methods and materials for attaching straps to buckle assemblies are well known in the art, and include, for example, clamping, crimping, sewing, or gluing the strap to the bar. The strap itself may be constructed of any suitable material, though an elastic strap is particularly well-suited to securing a sport-goggle assembly to a user's head during operation. For example, an elastic strap has compliant qualities that allow the goggles to be held firmly in place while still allowing the user to adjust the strap without discomfort or undue effort.

In a particular embodiment of the strap-buckle assembly, the pivotable member 308 may be removed and replaced by the user. As shown in FIG. 3A, for example, the pivotable bar 308 may be removed by applying pressure to points on the frame 4 generally along the lines X and X', which causes the frame 304 to deflect in a direction roughly corresponding to directions Y and Y'. The deflection increases the distance between the holes 310 on the frame, which in turn allows the pivotable bar 308 to be removed from buckle assembly. This feature allows the user to replace a damaged frame without replacing the entire strap and buckle assembly. Removal of the pivotable bar 308 according to this method is best achieved when the frame 302 is constructed of a suitably compliant, yet resilient, thermoplastic elastomer.

Figure 5:
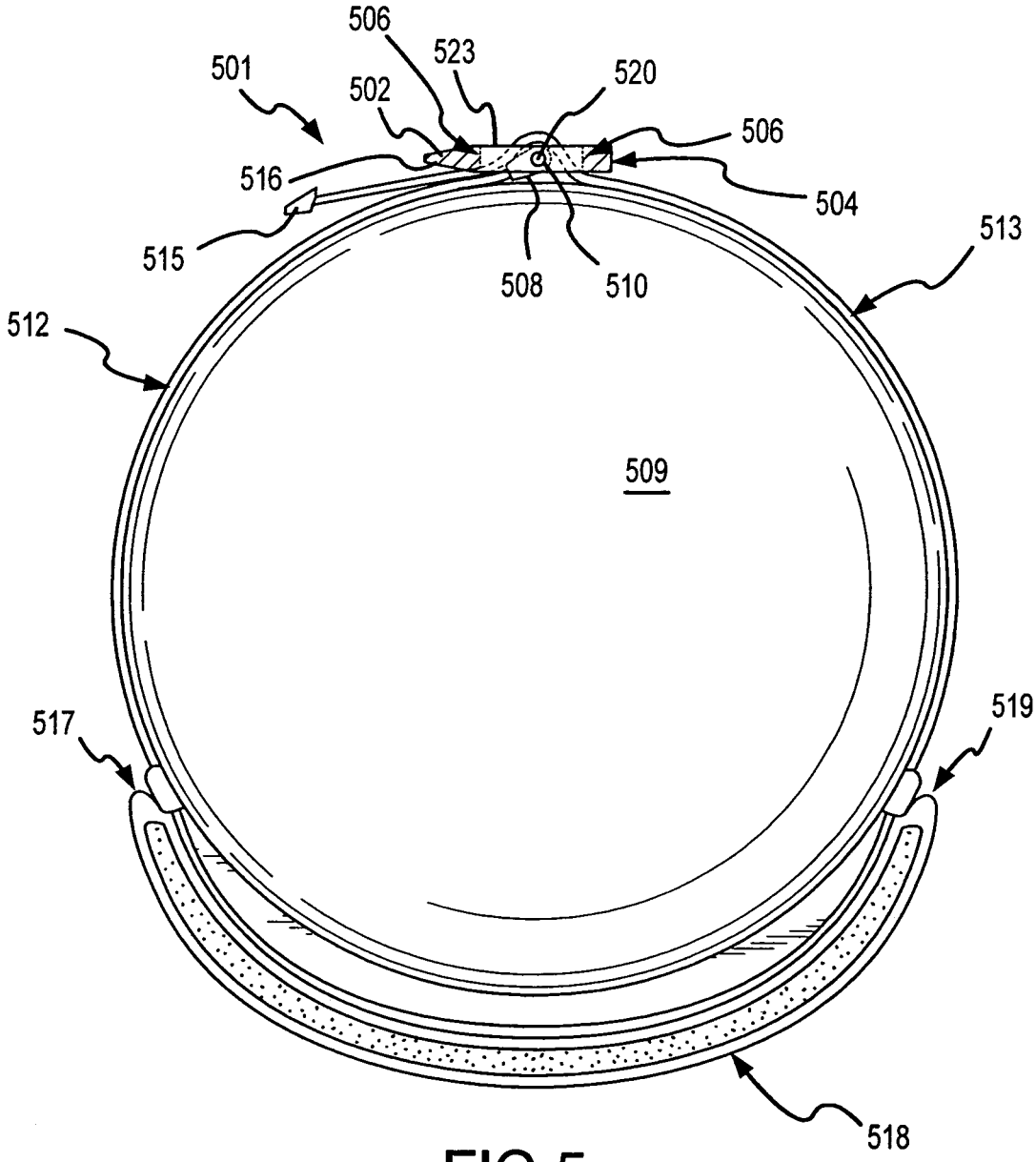
FIG. 5 is a top view of a buckle and strap assembly according to an embodiment of the present invention.

FIG. 5 is a top view of the buckle and strap assembly showing a particular configuration of a disclosed embodiment during operation. The buckle and strap assembly is shown holding goggles 518 securely against a user's head 509. A first strap 512 is attached to a first lateral side 517 of the sport goggles 518 at a first end, and is attached to the pivotable bar 508 of the buckle assembly 501. A second strap 513 is attached to a second lateral side 519 of the goggles 518 at a first end, and the terminal end 515 is threaded upwardly through a first slot 522 from the bottom of the buckle frame 502, over the pivotable bar 508, and downwardly through another slot 523 to project through the bottom to the frame 508.

During operation, the pivotable bar 508 is pivoted towards slot 523 through which the terminal end 515 of the strap 513 is threaded, and is wedged between the user's head 509 and the strap 513. When the strap 513 tension is increased, the pivotable bar 508 presses against the user's head and is forced into the slot 523 and against the strap 513. Such positioning of the pivotable bar 508 serves to hold the strap 513 more securely in the slot 523, and thus maintaining the desired tension on the strap.

Figure 4:
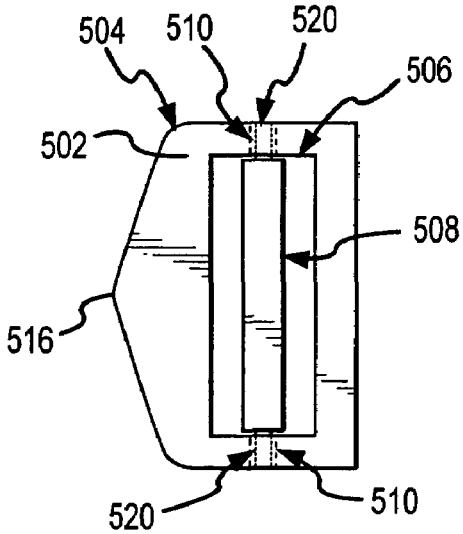
FIG. 4 is a plan view of a buckle assembly according to another embodiment of the present invention.

The pivotable bar 508 further serves to facilitate loosening of the buckle and strap assembly during use. As shown in FIGS. 4 and 5, the buckle frame 502 may further include a flange 516 for lifting the side of the buckle frame 502 that is generally parallel to slot 523. When the user lifts the frame 502 by lifting up on flange 516, the frame 502 pivots relative to the bar 508 and the strap 513 becomes less restricted to move through the slot 523 because the impingement on the strap 513 from the pivotable bar 508 is decreased. The larger surface area provided by the flange 516 facilitates faster and easier release of the strap tension. This is especially true where the user is wearing gloves, which tend to decrease digital dexterity.

Figure 7:
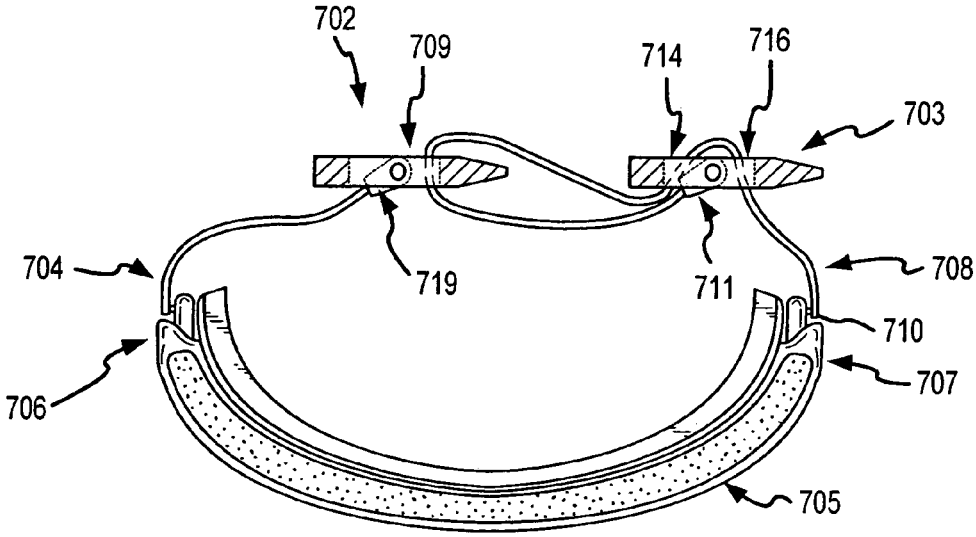
FIG. 7 is a top view of a goggle, straps and buckles assembly according to an embodiment of the present invention.

FIG. 7 is a top view of a sport-goggles assembly having a plurality of pivotable buckle assemblies to both secure and adjust the overall length of the strap assembly. Two straps 704, 708 are attached to opposed lateral sides 706, 707 of a pair of goggles 705. The straps 704, 708 are attached to pivotable buckle assemblies 702, 703, as described with respect to FIG. 3. With respect to the strap 708, the terminal end 710 is threaded upwardly through the slot 709 on the buckle assembly 702, and brought back towards the buckle assembly 703. The terminal end 710 of the strap 708 is then threaded upwardly through the slot 714, fed over the pivotable bar 711, and threaded downwardly through the slot 716. The terminal end 708 is then fastened to the lateral side 707 of the sport goggles 705. When the straps and buckle assemblies are assembled thusly, the buckle assembly 703 may be slid to and fro along the length of the strap 708 to lengthen and shorten the strap assembly.

During the pursuit of various outdoor sports such as skiing, motorcycle racing, or snowmobiling, the user may require, at certain times, the use of a helmet in association with the use of sport goggles. Because the circumference of the typical helmet is so much greater than the circumference of the average human head, it is often difficult to provide a sport-goggles assembly that includes enough strap to accommodate a helmet and yet can be adjusted securely to the user's head without leaving excess slack. It is expensive, however, to purchase separate sets of sport goggles having different strap lengths for use with and without a helmet.

Figure 6:
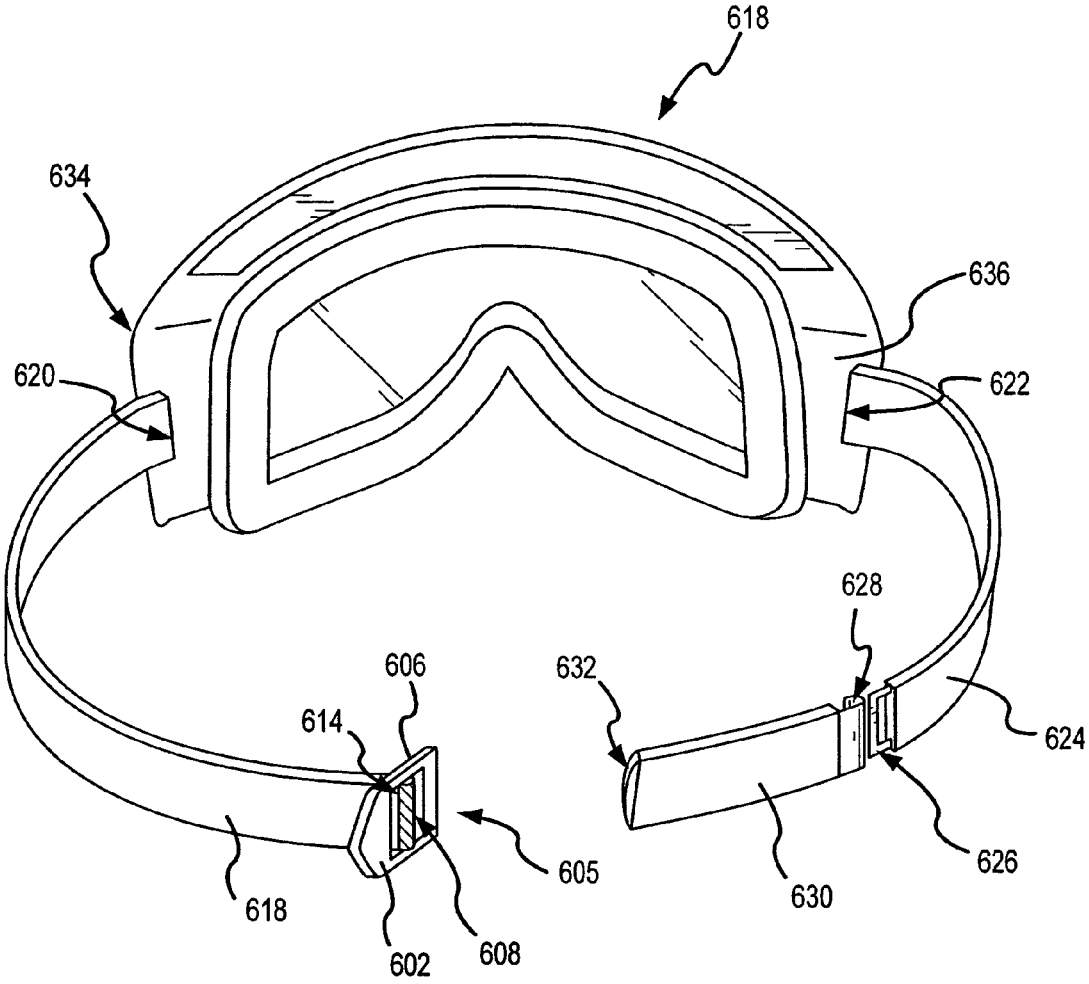
FIG. 6 is an illustration of a buckle, strap, strap extension, and goggle assembly according to an embodiment of the present invention.

FIG. 6 is an illustration of a sport-goggle assembly including a strap-lengthening member 630 that may be selectively added or removed from the sport-goggles assembly according to whether the user requires an increase in the overall length of the strap. The strap-lengthening member 630 may be used in association with the disclosed pivotable strap-buckle assemblies, and allows use of the same sport-goggles assembly either with or without a helmet. As shown in FIG. 6, two straps 618, 624 are attached to opposing lateral sides 634, 636 of a sport-goggles assembly at respective first ends 620, 622 of the straps 618, 624. The second end of the first strap 618 is attached to the pivotable bar 608 of the buckle assembly along a longitudinal axis 614 of the bar 618 as described with respect to FIG. 3. The pivotable bar 608 may be pivotably attached to opposed regions of the interior border 606 of the buckle frame 602 as shown, for example, in FIG. 3, or in any manner that allows the bar 608 to pivot within the frame 602 of the buckle assembly. The second strap 624, which is attached to the second lateral side 636 of the goggles at a first end 622, has a second end 626 that may be either threaded through the buckle assembly 605 or attached to a third strap member 630. The third strap member 630 provides additional potential strap-length to the sport-goggle assembly, thereby allowing the user to selectively use the sport-goggles assembly with a helmet that has a greater overall circumference than the user's head. One end 628 of the third strap 630 may be selectively attached to the second end 626 of the second strap 624 by way of any suitable attachment apparatus, such as hook and eye, snaps, or clasps. The second end 632 of the third strap 630 is engageable with the buckle assembly 605 as described, for example, with respect to FIG. 5.

Figure 8A:
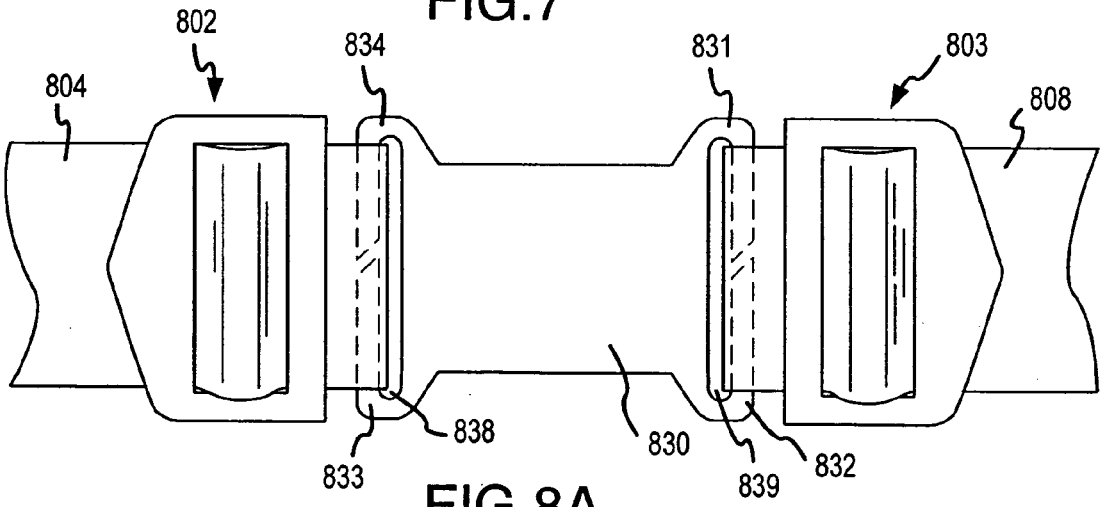
FIG. 8A is plan view of a buckles, straps, and strap extension assembly according to an embodiment of the present invention.
Figure 8B:
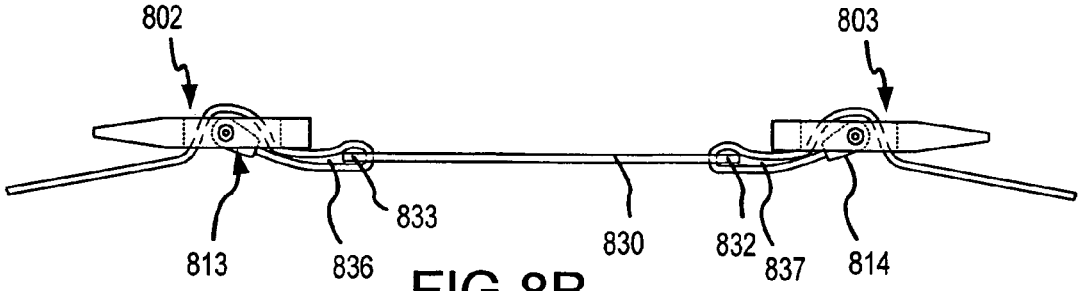
FIG. 8B is a side view of a buckles, straps, and strap extension assembly according to an embodiment of the present invention.

FIGS. 8A and 8B are illustrations of a strap lengthening member that may be used in association with a plurality of pivotable buckle assemblies, such as the assembly shown in FIG. 7. In the embodiment disclosed in FIG. 8, the strap lengthening member 830 has a set of two hooks 831, 832 at a first end, and a set of two hooks 833, 834 at a second end. As best shown in FIG. 8A, the hooks define a pair of slots 838, 839 in which straps 804, 808 may be looped. Where the pivotable members 813, 814 are selectively detachable, as described with respect to FIG. 3A for example, use of the strap-lengthening member 830 with a sport-goggles assembly allows the assembly to be used both with and without a helmet. In addition, the user is not required to employ separate sport-goggles assemblies for use with and without a helmet.

The strap lengthening member 830 shown in FIG. 8 may be formed of a single piece of rubber, plastic or any other suitably resilient and flexible material. The strap-lengthening member need not be of unitary construction, and may be formed of an elongated piece of material, such as an elastic strap, with hooks attached to the ends sufficient to secure the loops 836, 837 on the straps 804, 808.

The above description of illustrated embodiments of the invention is not intended to be exhaustive or to limit the invention to the precise form disclosed. While specific embodiments of, and examples of, the invention are described in the foregoing for illustrative purposes, various equivalent modifications are possible within the scope of the invention, as those skilled in the relevant art will realize. Moreover, the various embodiments described above can be combined to provide further embodiments. Accordingly, the invention is not limited by the disclosure, but instead the scope of the invention is to be determined entirely by the following claims.

What is claimed is:

1. A buckle assembly for securing and adjusting a strap, comprising:

a frame having an exterior border and an interior border, the interior border having opposed regions; and a pivotable member pivotably attached to two opposed portions of the interior border, the pivotable member being selectively detachable from the frame, the pivotable member having a longitudinal axis and being adapted to attach to a strap along the longitudinal axis, the pivotable member and the interior border defining a first slot and a second slot.

2. The buckle assembly of claim 1 wherein the strap is attached to the pivotable member along the longitudinal axis.

3. The buckle assembly of claim 1 wherein the strap is elastic.

4. The buckle assembly of claim 1, further comprising a flange on the exterior border of the frame, the flange being located along a region of the exterior border generally parallel to the longitudinal axis of the pivotable member.

5. The buckle assembly of claim 1 wherein a strap is attached to the pivotable member along the longitudinal axis.

6. The buckle assembly of claim 1 wherein the strap is elastic.

7. The buckle assembly of claim 1 wherein the frame is configured to move apart portions of the two opposed portions of the interior border to allow the pivotable member to be removed from the frame responsive to applying a compressive force to opposing sides of the frame along an axis generally perpendicular to the longitudinal axis.

8. The buckle assembly of claim 1 wherein the frame comprises a resilient material.

9. The buckle assembly of claim 8 wherein the resilient material comprises an elastomer.

10. The buckle assembly of claim 1 wherein the first and second slots have an elongated geometry.

11. A buckle assembly for securing and adjusting a strap, comprising:

a frame having an exterior border and an interior border, the interior border having opposed regions;

a flange on the exterior border of the frame; and a pivotable member pivotably attached to two opposed portions of the interior border, the pivotable member being selectively detachable from the frame, the pivotable member having a longitudinal axis and being adapted to attach to a strap along the longitudinal axis, the pivotable member and the interior border defining a first slot and a second slot, the flange being located along a region of the exterior border generally parallel to the longitudinal axis of the pivotable member.

12. The buckle assembly of claim 11 wherein the frame is configured to move apart portions of the two opposed portions of the interior border to allow the pivotable member to be removed from the frame responsive to applying a compressive force to opposing sides of the frame along an axis generally perpendicular to the longitudinal axis.

13. The buckle assembly of claim 11 wherein the frame comprises a resilient material.

14. The buckle assembly of claim 13 wherein the resilient material comprises an elastomer.

15. The buckle assembly of claim 11 wherein the first and second slots have an elongated geometry.

16. A strap-buckle assembly, comprising:

an apparatus having a first lateral side and an opposing second lateral side;

a first strap attached to the first side of the apparatus;

a second strap having a first end and a second end, the first end being attached to the second lateral side of the apparatus; and a buckle assembly attached to the second end of the second strap, the buckle assembly including:

a frame having an exterior border and an interior border, the interior border having opposed regions;

a pivotable member pivotably attached to two opposed portions of the interior border, the pivotable member having a longitudinal axis; and the second end of the second strap attached to the pivotable member along the longitudinal axis.

17. The strap-buckle assembly of claim 16 wherein the pivotable member is selectively detachable from the frame.

18. The strap-buckle assembly of claim 16 wherein the first and second straps are elastic.

19. The strap-buckle assembly of claim 16, further comprising a flange on the exterior border of the frame, the flange being located along a region of the exterior border generally parallel to the longitudinal axis of the pivotable member.

20. The strap-buckle assembly of claim 16 wherein the pivotable member and the interior border define a first slot and a second slot.

21. The strap-buckle assembly of claim 16 wherein the frame is configured to move apart portions of the two opposed portions of the interior border to allow the pivotable member to be removed from the frame responsive to applying a compressive force to opposing sides of the frame along an axis generally perpendicular to the longitudinal axis.

22. The strap-buckle assembly of claim 16 wherein the frame comprises a resilient material.

23. The strap-buckle assembly of claim 22 wherein the resilient material comprises an elastomer.

24. The strap-buckle assembly of claim 16 wherein the first and second slots have an elongated geometry.

25. The strap-buckle assembly of claim 16 wherein the apparatus comprises eyewear.

26. The strap-buckle assembly of claim 16 wherein the pivotable member is selectively detachable from the frame.

27. A strap-buckle assembly, comprising:

an apparatus having a first lateral side and an opposing second lateral side;

a first strap having a first end and a second end, the first end being attached to the first lateral side of the apparatus;

a buckle assembly attached to the second end of the first strap, the buckle assembly including:

a frame having an exterior border and an interior border, the interior border having opposed regions;

a pivotable member pivotably attached to two opposed portions of the interior border, the pivotable member having a longitudinal axis; and the second end of the first strap attached to the pivotable member along the longitudinal axis;

a second strap having a first and second end, the first end being attached to the second lateral side of the apparatus and the second end being adapted to be selectively engageable with the buckle assembly or attached to a third strap; and a third strap having a first and second end, the first end being attached to the second end of the second strap and the second end adapted to be engageable with the buckle assembly.

28. The strap-buckle assembly of claim 27 wherein the first, second, and third straps are elastic.

29. The strap-buckle assembly of claim 27, further comprising a flange on the exterior border of the frame, the flange being located along a region of the exterior border generally parallel to the longitudinal axis of the pivotable member.

30. The strap-buckle assembly of claim 27 wherein the pivotable member and the interior border define a first slot and a second slot.

31. The strap-buckle assembly of claim 27 wherein the frame is configured to move apart portions of the two opposed portions of the interior border to allow the pivotable member to be removed from the frame responsive to applying a compressive force to opposing sides of the frame along an axis generally perpendicular to the longitudinal axis.

32. The strap-buckle assembly of claim 27 wherein the frame comprises a resilient material.

33. The strap-buckle assembly of claim 32 wherein the resilient material comprises an elastomer.

34. The strap-buckle assembly of claim 27 wherein the first and second slots have an elongated geometry.

35. The strap-buckle assembly of claim 27 wherein the apparatus comprises eyewear.

36. A strap-buckle assembly, comprising:

an apparatus having a first lateral side and an opposing second lateral side;

a first strap having a first end and a second end, the first end being attached to the first lateral side of the apparatus;

a first buckle assembly attached to the second end of the first strap, the buckle assembly including:

a frame having an exterior border and an interior border, the interior border having opposed regions;

a pivotable member pivotably attached to two opposed portions of the interior border, the pivotable member having a longitudinal axis; and the second end of the first strap attached to the pivotable member along the longitudinal axis;

a second strap having a first and second end, the first end being attached to the second lateral side of the apparatus; and a second buckle assembly attached to the second end of the second strap, the buckle assembly including:

a frame having an exterior border and an interior border, the interior border having opposed regions; and a pivotable member pivotably attached to two opposed portions of the interior border, the pivotable member having a longitudinal axis; and the second end of the second strap attached to the pivotable member along the longitudinal axis.

37. The strap-buckle assembly of claim 36 wherein the first strap forms a first loop through the first buckle assembly and the second strap forms a second loop through the second buckle assembly and further comprising a strap-lengthening member having first and second opposed ends connected to the first loop at the first opposed end and connected to the second loop at the second opposed end.

38. The strap-buckle assembly of claim 36 wherein the pivotable members of the first and second buckle assemblies are selectively detachable from the frame.

39. The strap-buckle assembly of claim 36 wherein the first and second straps are elastic.

40. The strap-buckle assembly of claim 36 wherein each of the first and second buckle assemblies comprise a flange on the exterior border of the frame, the flange being located along a region of the exterior border generally parallel to the longitudinal axis of the pivotable member.

41. The strap-buckle assembly of claim 36 wherein the pivotable member and the interior border define a first slot and a second slot.

42. The strap-buckle assembly of claim 36 wherein the frame is configured to move apart portions of the two opposed portions of the interior border to allow the pivotable member to be removed from the frame responsive to applying a compressive force to opposing sides of the frame along an axis generally perpendicular to the longitudinal axis.

43. The strap-buckle assembly of claim 36 wherein the frame comprises a resilient material.

44. The strap-buckle assembly of claim 43 wherein the resilient material comprises an elastomer.

45. The strap-buckle assembly of claim 36 wherein the first and second slots have an elongated geometry.

46. The strap-buckle assembly of claim 36 wherein the apparatus comprises eyewear.

* * * * *

UNITED STATES PATENT AND TRADEMARK OFFICE

CERTIFICATE OF CORRECTION

PATENT NO. : 7,000,263 B2
APPLICATION NO. : 10/946215
DATED : February 21, 2006
INVENTOR(S) : Joseph Ross McNeal It is certified that error appears in the above-identified patent and that said Letters Patent is hereby corrected as shown below:

| Column, Line | Reads | Should Read |
|---|---|---|
| Column 1, Line 49 | "3 to and fro along the" | --3 to and from along the-- |
| Column 3, Line 15 | "FIG. 8A is plan view of" | --FIG. 8A is a plan view of-- |
| Column 4, Line 2 | "the pivotable member 308" | --the pivotable bar 308-- |
| Column 4, Line 27 | "bottom to the frame 508" | --bottom to the frame 502-- |
| Column 4, Line 63 | "The terminal end 708" | --The terminal end 710-- |
| Column 4, Line 66 | "be slid to and fro along" | --be slid to and from along-- |
| Column 5, Line 25 | "bar 618 as described" | --bar 608 as described-- |
| Column 5, Line 53 | "FIG. 3A for example," | --FIG. 3A. For example,-- |

Signed and Sealed this

Eleventh Day of March, 2008

JON W. DUDAS
*Director of the United States Patent and Trademark Office*